US008308545B2

(12) United States Patent
Gomez et al.

(10) Patent No.: US 8,308,545 B2
(45) Date of Patent: Nov. 13, 2012

(54) WAGERING GAME WITH ENHANCED PLAYER-SELECTION BONUS FEATURE

(75) Inventors: Benjamin T. Gomez, Chicago, IL (US); James V. Palermo, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 208 days.

(21) Appl. No.: 12/739,547

(22) PCT Filed: Nov. 7, 2008

(86) PCT No.: PCT/US2008/082743

§ 371 (c)(1),
(2), (4) Date: Apr. 23, 2010

(87) PCT Pub. No.: WO2009/061994

PCT Pub. Date: May 14, 2009

(65) Prior Publication Data

US 2010/0234093 A1 Sep. 16, 2010

Related U.S. Application Data

(60) Provisional application No. 61/002,716, filed on Nov. 9, 2007.

(51) Int. Cl.
*A63F 9/24* (2006.01)

(52) U.S. Cl. ..... 463/16; 463/20; 463/25; 463/42

(58) Field of Classification Search ..... 463/16
See application file for complete search history.

(56) References Cited

U.S. PATENT DOCUMENTS

| | | | | |
|---|---|---|---|---|
| 3,281,149 | A | 10/1966 | Miller | 273/143 |
| 4,095,795 | A | 6/1978 | Saxton et al. | 273/143 R |
| 4,238,127 | A | 12/1980 | Lucero et al. | 273/143 R |
| 4,306,768 | A | 12/1981 | Egging | 350/174 |
| 4,335,809 | A | 6/1982 | Wain | 194/1 R |
| 4,448,419 | A | 5/1984 | Telnaes | 273/143 R |
| 4,508,345 | A | 4/1985 | Okada | 273/143 R |
| 4,508,513 | A | 4/1985 | Donovan | 434/346 |
| 4,560,161 | A | 12/1985 | Hamano | 273/85 CP |
| 4,624,459 | A | 11/1986 | Kaufman | 273/143 R |
| 4,721,307 | A | 1/1988 | Okada | 273/143 R |

(Continued)

FOREIGN PATENT DOCUMENTS

AU 9748484 7/1998

(Continued)

OTHER PUBLICATIONS

Product Sheet for "Great Whites," 2 pages (2000).

(Continued)

*Primary Examiner* — Omkar Deodhar

(74) *Attorney, Agent, or Firm* — Nixon Peabody LLP

(57) ABSTRACT

A gaming system for conducting a wagering game includes a wager input device for receiving a wager from a player to play a wagering game. The system includes a display for displaying an array of selectable elements. Each of the selectable elements is associated with an award. The system also includes a player input device for receiving selections from the array of selectable elements. Also included in the gaming system is a feature for returning to the array of selectable elements. The feature includes at least one game-return outcome and at least one game-terminating outcome awarding a first award for the selections. A multiplier changes each time a game-return outcome is achieved.

21 Claims, 7 Drawing Sheets

U.S. PATENT DOCUMENTS

| | | | | |
|---|---|---|---|---|
| 4,763,256 | A | 8/1988 | DeMar | 364/410 |
| 4,772,023 | A | 9/1988 | Okada | 273/143 R |
| 4,805,907 | A | 2/1989 | Hagiwara | 273/138 A |
| 4,871,171 | A | 10/1989 | Rivero | 273/138 A |
| 5,083,785 | A | 1/1992 | Okada | 273/143 R |
| 5,169,147 | A | 12/1992 | Hamano | 273/138 A |
| 5,205,555 | A | 4/1993 | Hamano | 273/143 R |
| 5,259,616 | A | 11/1993 | Bergmann | 273/138 A |
| 5,292,127 | A | 3/1994 | Kelly et al. | 273/138 R |
| 5,342,047 | A | 8/1994 | Heidel et al. | 273/85 CP |
| 5,342,049 | A | 8/1994 | Wichinsky et al. | 271/119 R |
| 5,380,008 | A | 1/1995 | Mathis et al. | 273/143 R |
| 5,393,057 | A | 2/1995 | Marnell, II | 273/85 CP |
| 5,401,024 | A | 3/1995 | Simunek | 273/138 A |
| 5,415,404 | A | 5/1995 | Joshi et al. | 273/138 A |
| 5,429,361 | A | 7/1995 | Raven et al. | 273/138 A |
| 5,449,173 | A | 9/1995 | Thomas et al. | 273/143 R |
| 5,456,465 | A | 10/1995 | Durham | 273/138 A |
| 5,542,669 | A | 8/1996 | Charron et al. | 463/13 |
| 5,547,192 | A | 8/1996 | Ishibashi | 463/26 |
| 5,624,119 | A | 4/1997 | Leake | 273/269 |
| 5,647,798 | A | 7/1997 | Falciglia | 463/19 |
| 5,664,781 | A | 9/1997 | Feola | 273/292 |
| 5,697,843 | A | 12/1997 | Manship et al. | 463/20 |
| 5,704,835 | A | 1/1998 | Dietz, II | 463/20 |
| 5,722,891 | A | 3/1998 | Inoue | 463/20 |
| 5,779,545 | A | 7/1998 | Berg et al. | 463/22 |
| 5,788,573 | A | 8/1998 | Baerlocher et al. | 463/16 |
| 5,823,874 | A | 10/1998 | Adams | 463/17 |
| 5,848,932 | A | 12/1998 | Adams | 463/20 |
| 5,931,467 | A | 8/1999 | Kamille | 273/139 |
| 5,951,397 | A | 9/1999 | Dickinson | 463/36 |
| 5,980,384 | A | 11/1999 | Barrie | 463/16 |
| 6,012,982 | A | 1/2000 | Piechowiak et al. | 463/16 |
| 6,089,976 | A | 7/2000 | Schneider et al. | 463/16 |
| 6,089,978 | A | 7/2000 | Adams | 463/20 |
| 6,126,542 | A | 10/2000 | Fier | 463/16 |
| 6,783,457 | B2 | 8/2004 | Hughs-Baird et al. | 463/20 |
| 7,520,809 | B2 | 4/2009 | Thomas et al. | 463/20 |
| 2002/0049084 | A1* | 4/2002 | Hughs-Baird et al. | 463/20 |
| 2004/0038729 | A1 | 2/2004 | Webb et al. | 463/20 |
| 2004/0102243 | A1* | 5/2004 | Olsen | 463/25 |
| 2008/0015012 | A1* | 1/2008 | Englman et al. | 463/25 |
| 2009/0069063 | A1* | 3/2009 | Thomas et al. | 463/16 |
| 2009/0075717 | A1* | 3/2009 | Jaffe | 463/20 |

FOREIGN PATENT DOCUMENTS

| | | |
|---|---|---|
| DE | 37 00 861 | 7/1988 |
| DE | 40 14 477 | 7/1991 |
| EP | 0 142 371 | 5/1985 |
| EP | 0 148 001 | 7/1985 |
| EP | 0 333 338 | 9/1989 |
| EP | 0 577 415 | 1/1994 |
| FR | 1 474 617 | 3/1967 |
| GB | 1129607 | 10/1968 |
| GB | 1 476 848 | 6/1977 |
| GB | 1 591 623 | 6/1981 |
| GB | 2 066 991 | 7/1981 |
| GB | 2 072 395 | 9/1981 |
| GB | 2 083 936 | 3/1982 |
| GB | 2 084 371 | 4/1982 |
| GB | 2 096 376 | 10/1982 |
| GB | 2 097 160 | 10/1982 |
| GB | 2 105 891 | 3/1983 |
| GB | 2 106 685 | 4/1983 |
| GB | 2 117 952 | 10/1983 |
| GB | 2 144 644 | 3/1985 |
| GB | 2 147 442 | 5/1985 |
| GB | 2 147 773 | 5/1985 |
| GB | 2 152 262 | 7/1985 |
| GB | 2 153 572 | 8/1985 |
| GB | 2 157 047 | 10/1985 |
| GB | 2 165 385 | 4/1986 |
| GB | 2 170 636 | 8/1986 |
| GB | 2 180 087 | 3/1987 |
| GB | 2 181 589 | 4/1987 |
| GB | 2 183 882 | 6/1987 |
| GB | 2 191 030 | 12/1987 |
| GB | 2 197 974 | 6/1988 |
| GB | 2 202 984 | 10/1988 |
| GB | 2 204 436 | 11/1988 |
| GB | 2 210 191 | 6/1989 |
| GB | 2 222 712 | 3/1990 |
| GB | 2 226 907 | 7/1990 |
| GB | 2 229 565 | 9/1990 |
| GB | 2 230 373 | 10/1990 |
| GB | 2 233 806 | 1/1991 |
| GB | 2 242 300 | 9/1991 |
| GB | 2 253 154 | 9/1992 |
| GB | 2 262 642 | 6/1993 |
| GB | 2 270 787 | 3/1994 |
| GB | 2 273 384 | 8/1994 |
| GB | 2 287 567 | 9/1995 |
| GB | 2 297 857 | 8/1996 |
| GB | 2 298 508 | 9/1996 |
| WO | WO 88/08179 | 10/1988 |
| WO | WO 89/12875 | 12/1989 |
| WO | WO 92/10818 | 6/1992 |
| WO | WO 94/01840 | 1/1994 |
| WO | WO 97/27569 | 7/1997 |
| WO | WO 98/09259 | 3/1998 |

OTHER PUBLICATIONS

PCT International Search Report for International Application No. PCT/US/2008/82743 dated Jan. 16, 2009 (2 pages).

PCT International Written Opinion for International Application No. PCT/US/2008/82743 dated Jan. 16, 2009 (5 pages).

* cited by examiner

WAGERING GAME WITH ENHANCED PLAYER-SELECTION BONUS FEATURE

CROSS REFERENCE TO RELATED APPLICATIONS

This application is a U.S. national stage of International Application No. PCT/US2008/082743, titled "Wagering Game With Enhanced Player-Selection Bonus Feature" and filed Nov. 7, 2008, which claims priority to U.S. Provisional Patent Application Ser. No. 61/002,716, titled "Wagering Game With Enhanced Player-Selection Bonus Feature" and filed on Nov. 9, 2007, each of which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a wagering game having a collect/return feature that allows a player to return to a play field to continue making selections which are modified by a multiplier. With each return to the playfield, the multiplier changes in value.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system comprises a wager input device for receiving a wager from a player to play a wagering game and a display for displaying the wagering game. The wagering game includes a primary play field having an array of selectable elements. Each of the selectable elements is associated with an award. The gaming system further includes a player input device for receiving player selections and a collect/return input device. In response to a predetermined number of selections being made from the array of selectable elements, the collect/return input device allows the player to blindly select to collect the awards associated with the selected elements or allows the player to blindly select to re-enter the primary play field and continue making additional selections from the remaining unselected elements within the array of selectable elements. Upon re-entering the primary play field, a multiplier for modifying the awards associated with the additional selections is awarded each time the player returns to the primary play field.

According to another aspect of the invention, a method of conducting a wagering game on a gaming system comprises receiving a wager input for playing the wagering game having a primary play field and displaying the primary play field having an array of selectable elements. Each of the selectable elements is associated with an award. The method also includes receiving a first number of selections from the array of selectable elements and providing a player with a collect/return feature to collect the award associated with the first number of selections or to re-enter the primary play field. The collect/return feature is associated with at least one collect item and at least one re-enter item. The collect item and the re-enter item are indistinguishable to the player. The method further includes, in response to the player selecting a collect item, distinguishing the collect item from the re-enter item and providing the award associated with the first number of selections to the player. In response to the player selecting a re-enter item, the method includes (i) distinguishing the re-enter item from the collect item; (ii) redisplaying the primary play field with the array of remaining unselected selectable elements, (iii) receiving a second number of selections from the array of remaining unselected selectable elements and (iv) multiplying the awards associated with the second number of selections by a multiplier value.

According to yet another aspect of the invention, a computer readable storage medium is encoded with instructions for directing a gaming system to perform the above method.

According to another aspect of the invention, a gaming system comprises a wager input device for receiving a wager from a player to play a wagering game and a display for displaying an array of selectable elements. Each of the selectable elements is associated with an award. The system also comprises a player input device for receiving selections from the array of selectable elements and a feature for returning to the array of selectable elements. The feature includes at least one game-return outcome and at least one game-terminating outcome that awards a first award for the selections. The system further includes a multiplier that changes each time a game-return outcome is achieved.

According to a further aspect of the invention, a method of conducting a wagering game on a gaming system comprises receiving a wager input from a player to play the wagering game, displaying an array of selectable elements and receiving player selections from the array of selectable elements. Each of the selectable elements is associated with an award. The method also comprises displaying a feature for re-entering the array of selectable elements to make additional selections and receiving player input associated with the feature. The feature includes at least one game-return outcome and at least one game-terminating outcome. The method further comprises re-entering the array of selectable elements and receiving an additional number of selections from the array of selectable elements and multiplying the awards associated with the additional number of selections by a multiplier value that increases with each game-return outcome that is achieved.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
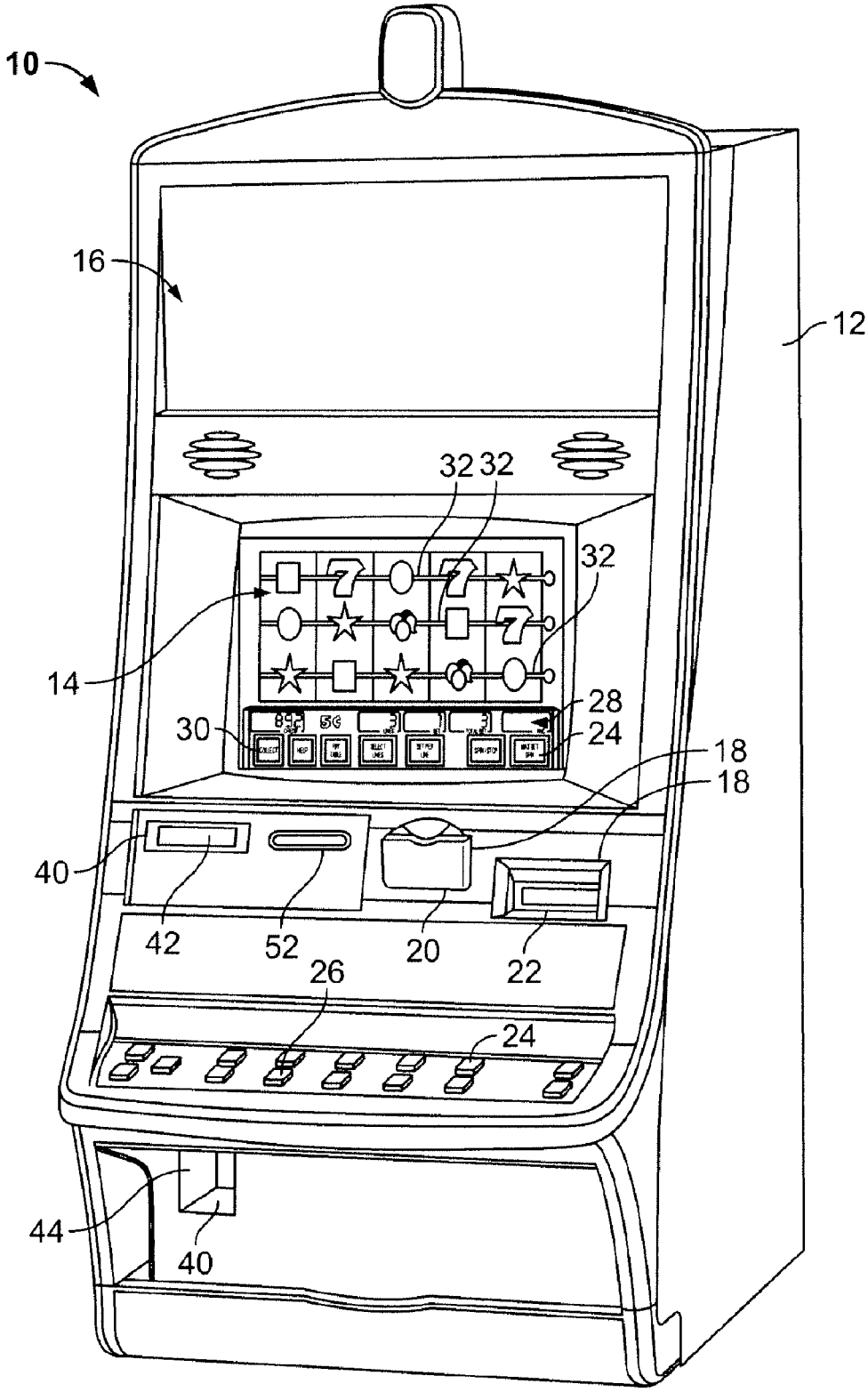
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
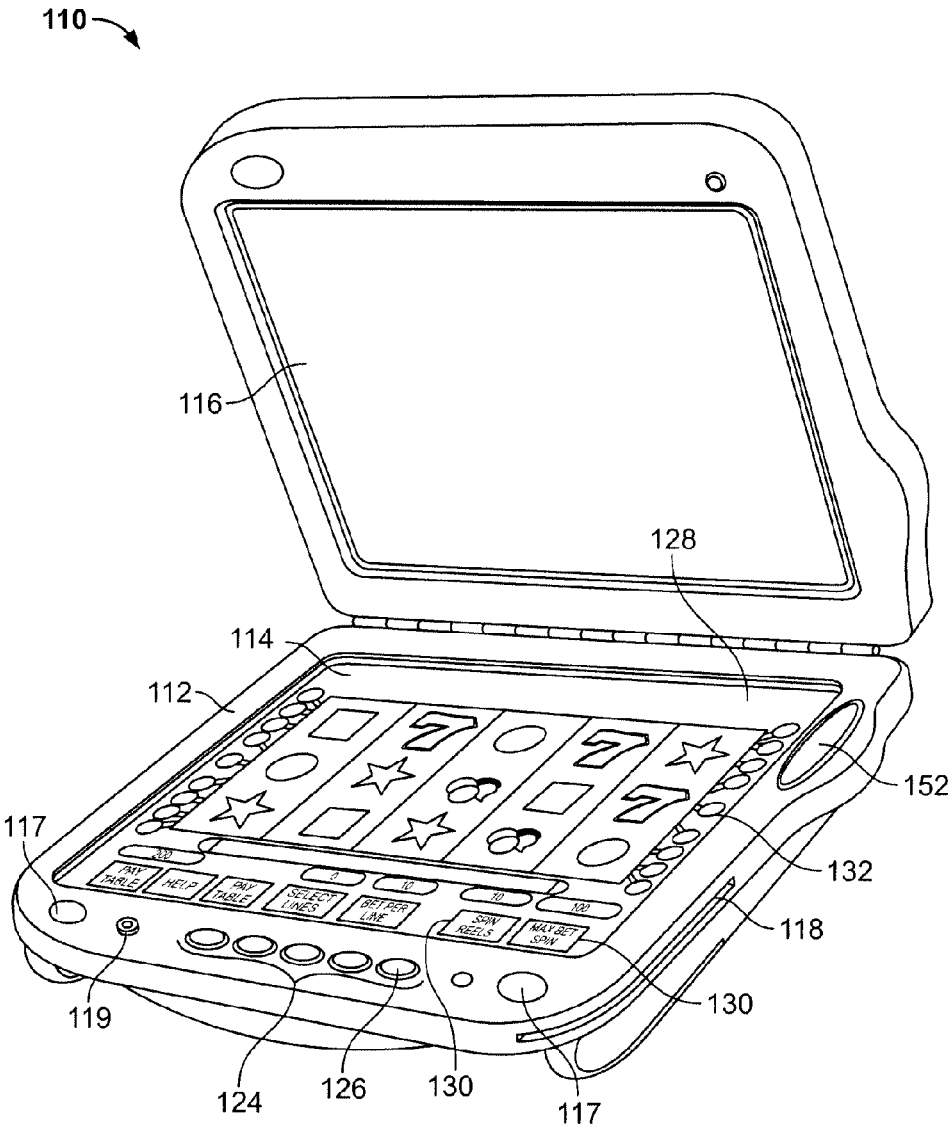
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126.

Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
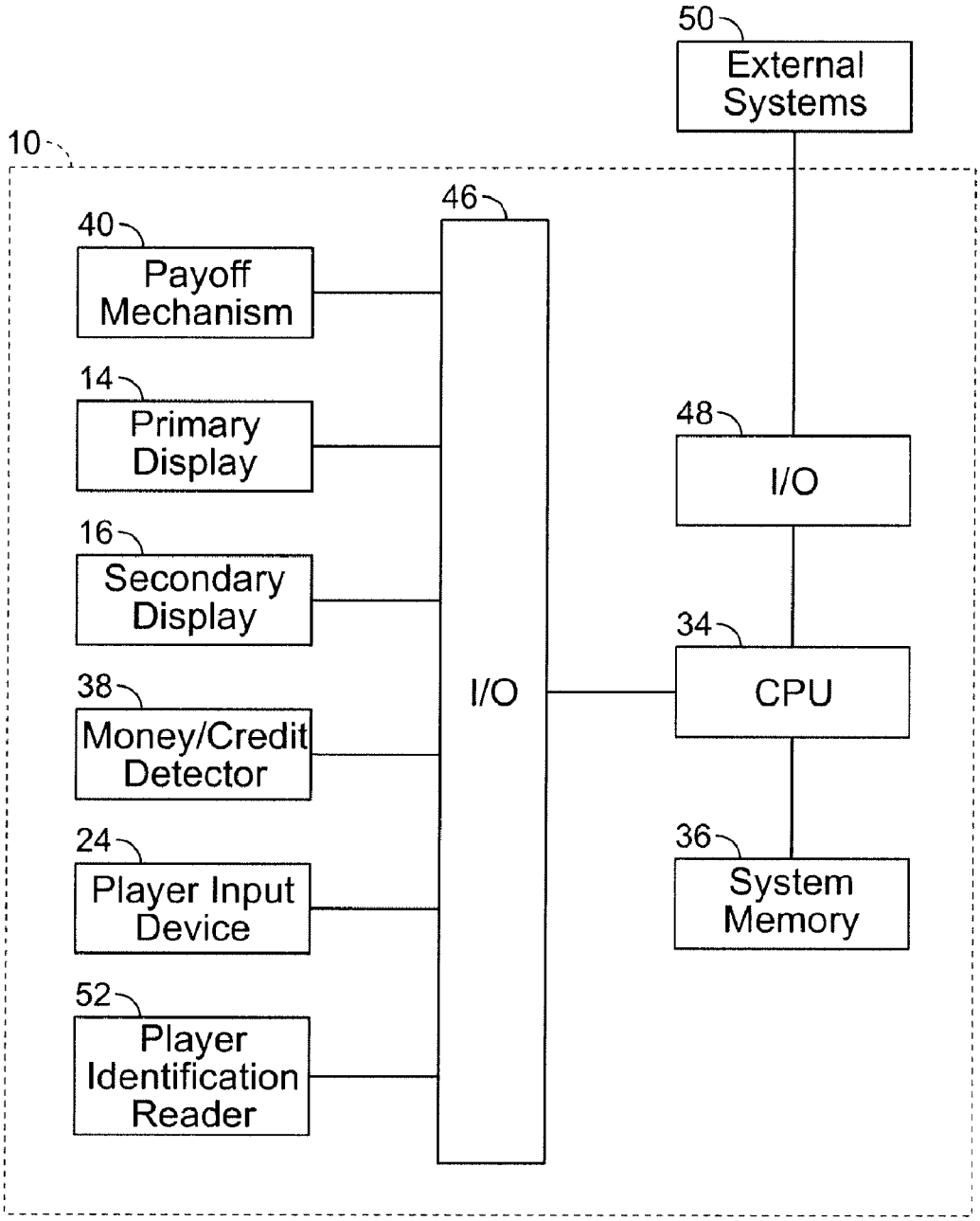
FIG. 2 is a block diagram of a control system suitable for operating the gaming machines of FIGS. 1*a* and 1*b*.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to another) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

Figure 3:
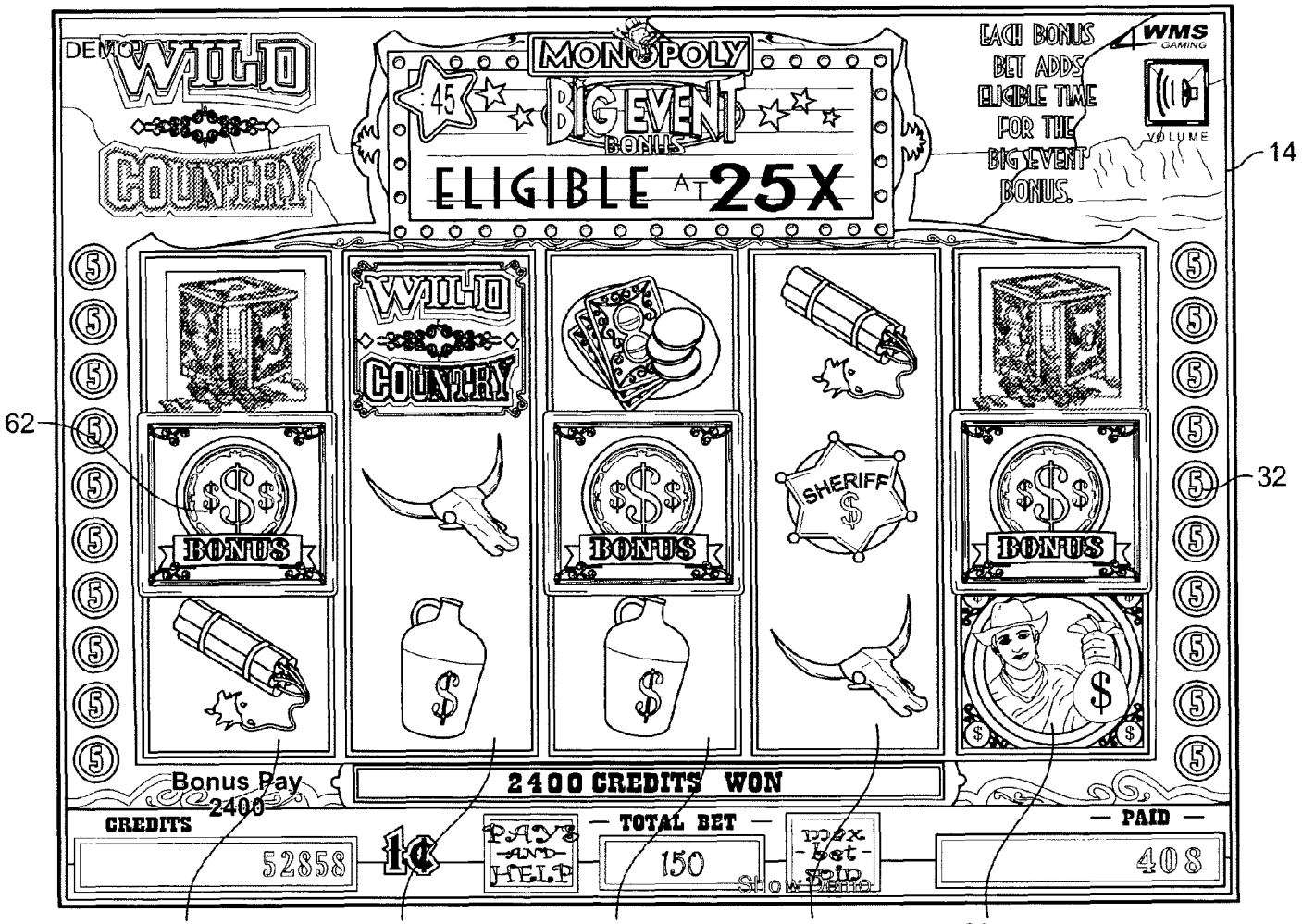
FIG. 3 is a view of a display displaying a wagering game embodying the present invention.

Turning now to FIG. 3, the primary display 14 displays a five-reel video display of a basic game. The basic game consists of a plurality of symbols on each of the five reels 60*a-e*, and includes a plurality of paylines 32 that are in visual association with one or more outcomes of the basic game. Such outcomes are randomly selected in response to the wagering input by the player. At least one of the plurality of randomly-selected outcomes may be a start-bonus outcome, which may include any symbol or symbol combination that triggers a bonus game. In the example shown in FIG. 3, a start-bonus outcome is triggered by three or more bonus symbols 62 appearing scattered on any reel 60*a-e*. Alternatively, the bonus symbols 62 may appear along a payline 32 to trigger the start-bonus outcome. In yet other embodiments, the bonus game may be triggered by a non-symbol-related event that is unrelated to the outcome displayed on the reels 60*a-e*. Such an event may be triggered by a random selection of a player or by certain factors relative to the wagering game, such as the amount of time since a player last returned to the bonus game, the number of wager inputs over a given time period, the amount of wager inputs over a given time period, etc.

Figure 4:
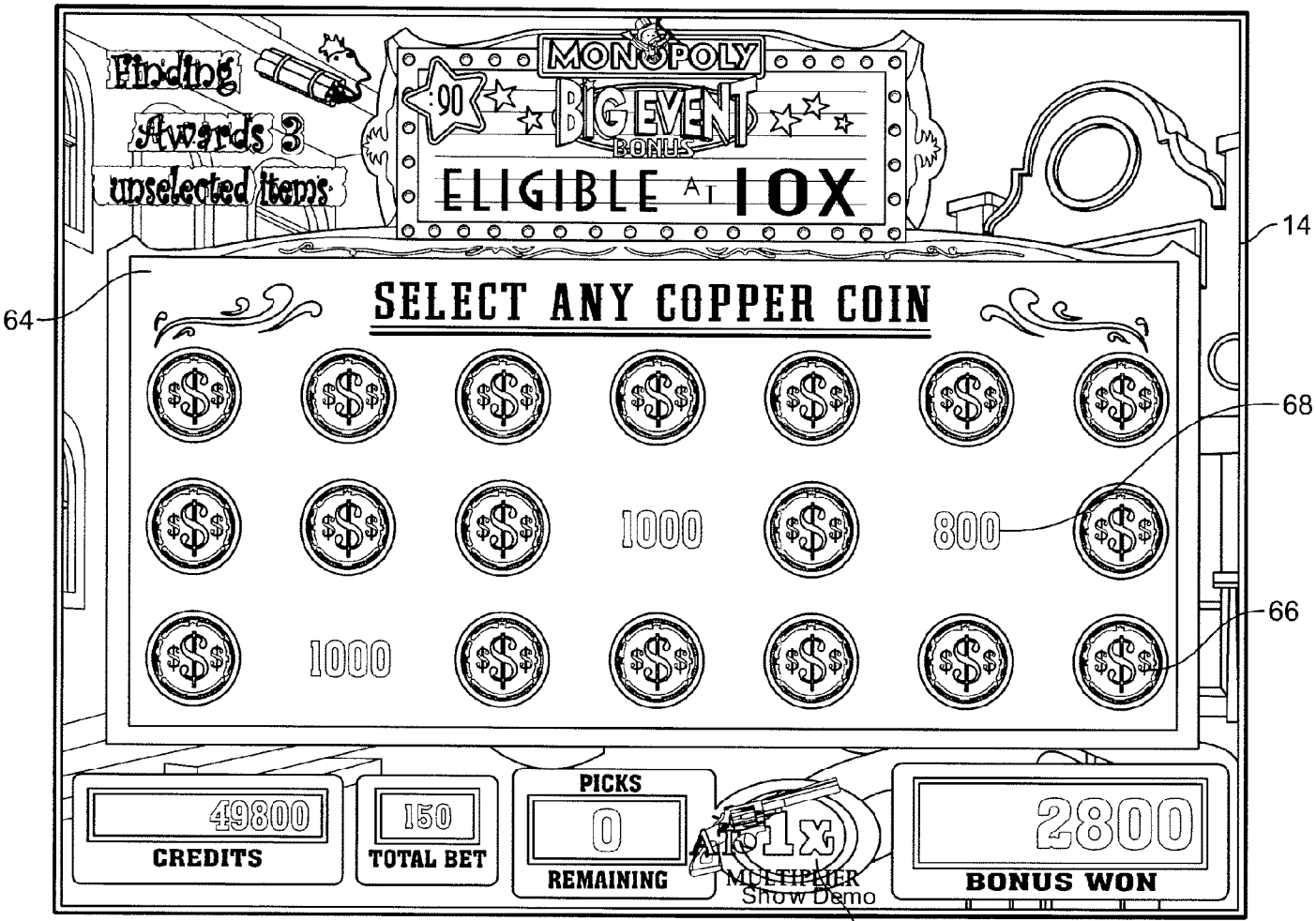
FIG. 4 is a view of a display displaying a primary play field having an array of selectable elements.

Upon achieving the start-bonus outcome, a primary play field 64 is displayed on the display 14, as shown in FIG. 4. The primary play field 64 includes an array of selectable elements 66, e.g., copper coins. The array may include any arrangement of selectable elements 66 and is not limited to a particular ordering of the elements. For example, the array shown in FIG. 4 includes three rows and seven columns of selectable elements 66. However, the array is not meant to be limited to this particular arrangement and may include other groupings of selectable elements 66. Furthermore, even though FIG. 4 illustrates a primary play field 64 having selectable elements 66 as a bonus game, it is contemplated that other elements may be displayed as the result of achieving a start-bonus outcome. The other elements may include free spins, dice throws, etc. instead of or in addition to the selectable elements 66 shown in FIG. 4.

Within the primary play field 66, there are no game-terminating outcomes. Instead, each of the selectable elements 66 is associated with an award 68 which is not revealed to the player before selection. The player is prompted to select a predetermined number of selectable elements 66 within the primary play field 64, each having an award 68. As shown in FIG. 4, the player has made three selections associated with awards 68 of 1000, 1000 and 800 credits.

Figure 5:
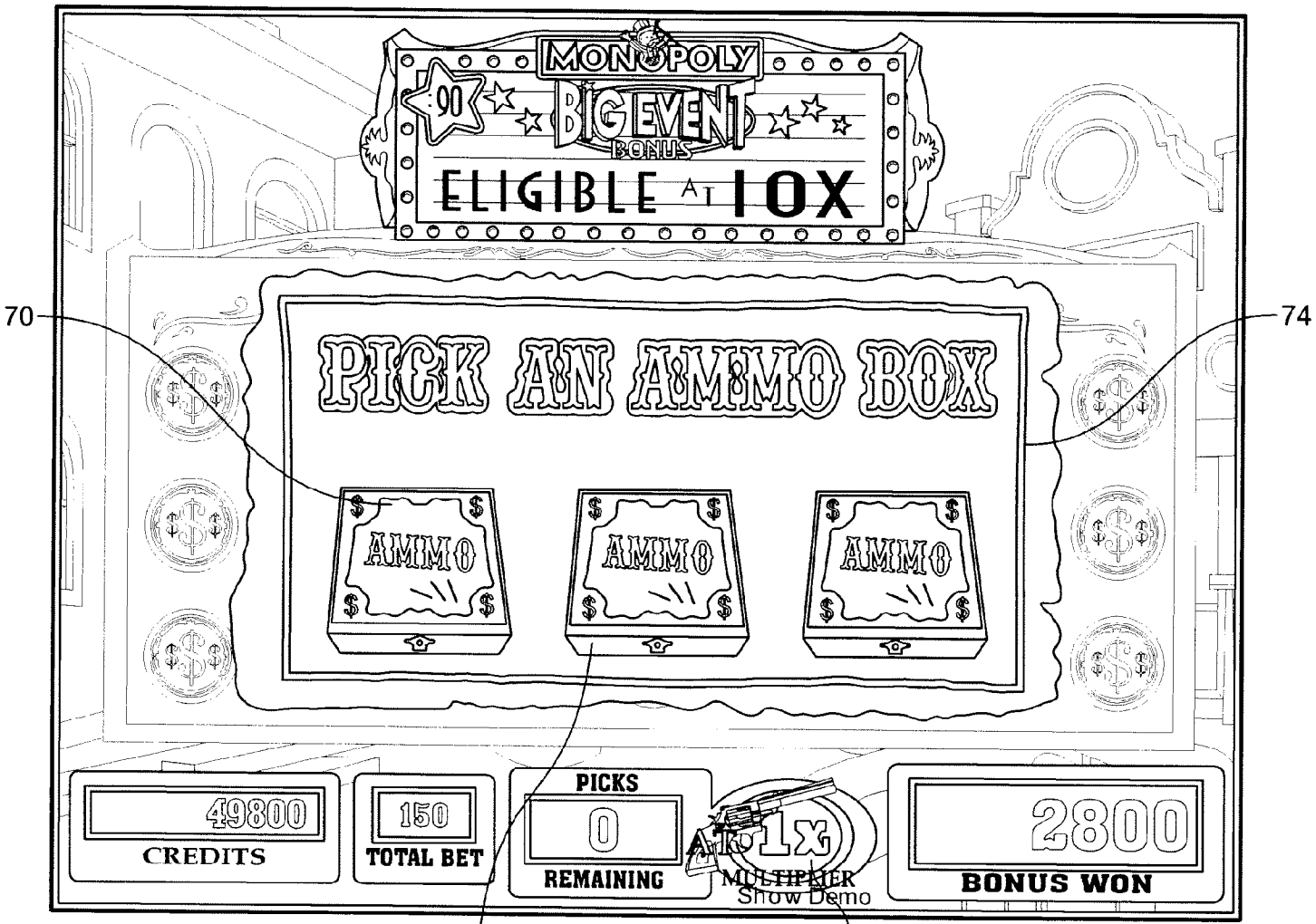
FIG. 5 is a view of a display displaying a collect/return feature for collecting an award or returning to the primary play field.

Once the player has made the predetermined number of selections, a secondary feature 70, such as a collect/return input device, prompts the player to blindly select from a secondary play field 74, as shown in FIG. 5. The secondary feature 70 allows the player to collect the awards 68 associated with the selected elements from the primary play field 64 (i.e., the "collect" feature) or to re-enter the primary play field 64 to continue making additional selections from the remaining unselected selectable elements 66 (i.e., the "return" feature). In one embodiment shown in FIG. 5, the secondary feature 70 may include a set of selectable items 72 (e.g., "Ammo Boxes") that are unrevealed to the player. Once selected, one of the selectable items 72 may reveal an element that allows a player to return to the primary play field 64 and continue to make a number of additional selections (e.g., "3 more shots"). Alternatively, one of the selectable items 72 may reveal a collect-awards element that is a game-terminating outcome (e.g., "empty") that ends the bonus game and awards any accumulated awards. In other embodiments, the secondary feature 70 may include a button or other input feature for receiving a player's selection in addition to or instead of the set of selectable items 72.

The number of items included in the set of selectable items 72 may vary and the proportion of collect items to return items within the set may also vary. For example, the first time that a player is prompted with a collect/return feature 70, the number of return items may be greater than the number of collect items to give the player a greater chance to return the primary play field 64, i.e., two return items and one collect item. When the player returns at a later time to the primary play field 64, the number of return items may be less than the number of collect items such that the player has a decreased chance of returning to the primary play field 64, i.e., one return item and two collect items. The selectable items are indistinguishable from each other such that the player does not know which item will be revealed until a selection is made. Once selected, the collect item is distinguished from the return item and vice-versa.

Figure 6:
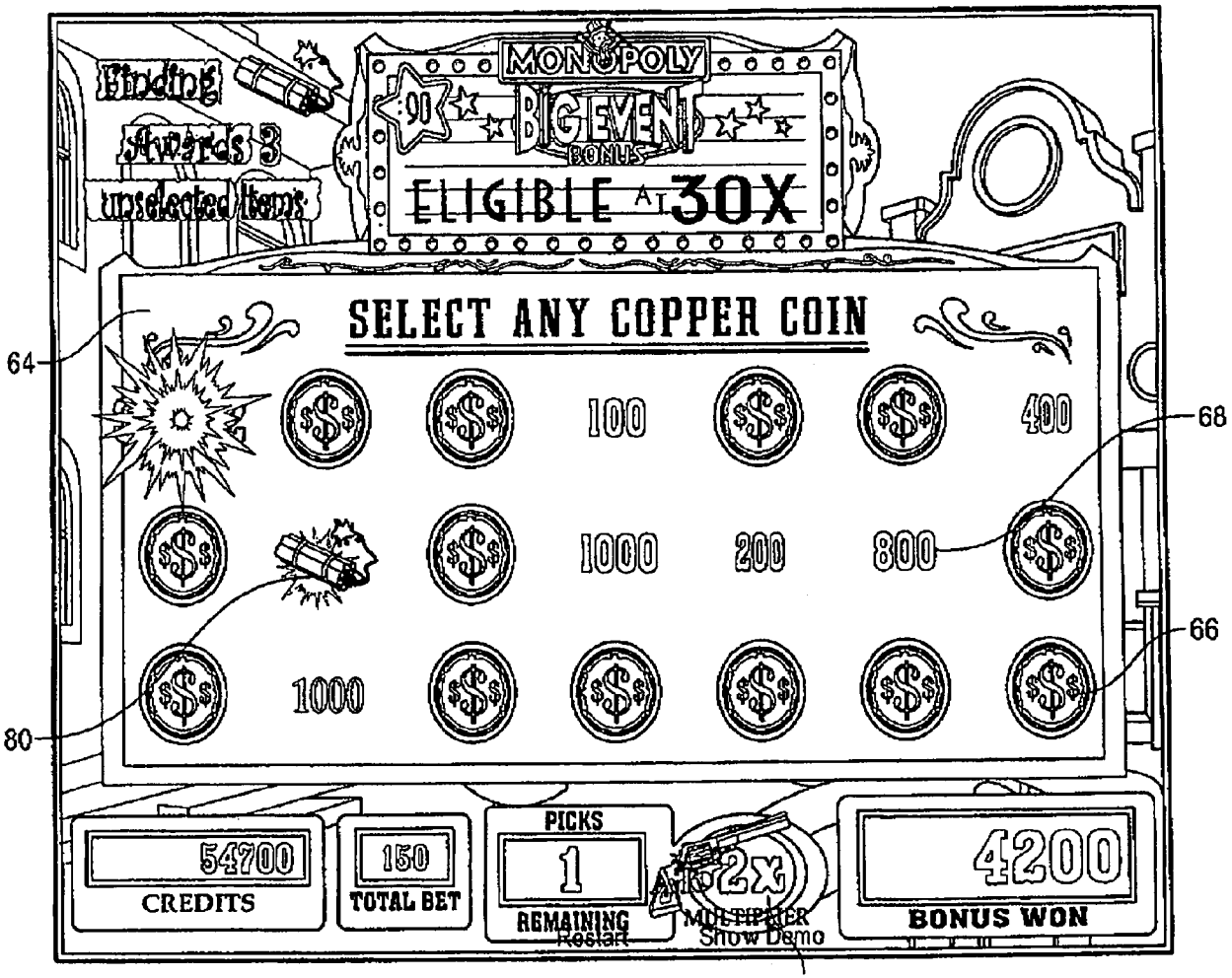
FIG. 6 is a view of a display displaying a return to the primary field where additional selections of selectable elements have been made.

Once the player re-enters the primary play field 64 by selecting a return item, the player makes additional selections from the remaining unselected selectable elements 66. For example, as shown in FIG. 6, the player has returned to the primary play field 64 and is prompted to make additional selections from the remaining unselected selectable elements 66. The additional number of selections that are made by the player may be the same as the number of initial selections that were made during the first display of the primary play field 64, or the number of additional selections may increase, decrease or be a randomly-assigned number of selections according to different embodiments.

In the example shown in FIG. 6, the player makes three additional selections associated with awards of 100, 200 and 400 credits. In some embodiments, the additional selections may be modified by a multiplier 76. For example, by returning to the primary play field 64, the awards 68 associated with the additional selections are modified by a "2×" multiplier 76 such that the awards are doubled. According to some embodiments, with each return to the primary play field 64, the multiplier 76 may change. For example, the multiplier 76 may change in a predetermined manner, i.e., by increasing to the next integer value, i.e., 1×, 2×, 3×, etc., or by increasing by multiple integer values, i.e., 2×, 4×, 6×, etc. In other embodiments, the multiplier 76 may change in a cyclical manner, i.e., by increasing the multiplier value in one return and then decreasing the multiplier value the next return to the primary play field 64. In other embodiments, the multiplier 76 may remain constant or may change in a completely random fashion so that the player will not be able to anticipate the next multiplier value.

After the player makes the additional selections in the primary play field 64, the secondary feature 70 may again prompt the player to select from another secondary play field 74, which may have the same or different number of collect items and return items as discussed above. The player may again make a selection via the secondary feature 70 that allows the player to collect the awards 68 associated with the additional selected elements from the primary play field 64 (i.e., the "collect" feature) or to re-enter the primary play field 64 to continue making additional selections from the remaining unselected selectable elements 66 (i.e., the "return" feature).

The secondary feature 70 may continue to be provided to the player until the player selects a game-terminating outcome, such as a collect item, which awards the accumulated awards and ends the bonus game. In some embodiments, the secondary feature 70 may continue to be provided until the player has returned to the primary play field 64 enough times to have selected all of the selectable elements 66 in the primary play field 64. Alternatively, the secondary feature 70 may continue to be provided until a specific multiplier value is achieved, such as a "5×" multiplier, in the case of a multiplier value that changes in a predetermined manner. In other embodiments, the secondary feature 70 is provided to the player a predetermined number of times, such as providing the secondary feature 70 a maximum of four times. In yet other embodiments, the primary play field 64 may be reset such that the player continues to make selections even after selecting all of the selectable elements 66, after achieving a specific multiplier value or after receiving the secondary feature 70 a predetermined number of times. The resetting of the primary play field 64 provides a new set of selectable elements 66 for selection by the player.

In some embodiments, the player will receive the sum of the awards accumulated each time the player re-enters the primary play field 64. For example, for the player shown in FIG. 6, the accumulated award would be 4200 credits, i.e., the 2800 credits from the first selections plus the 1400 credits from the additional selections multiplied by the "2×" multiplier. In alternative embodiments, the player may elect to discard the first selections in the hopes of receiving larger awards in subsequent selections. Thus, the player would receive only the awards associated with the selections made during the last return to the primary play field 64. In the example shown in FIG. 6, this would result in the player only being awarded 1400 credits.

In some embodiments, certain selectable elements 66 in the primary play field 64 may be associated with enhanced features for adding additional excitement and anticipation to the wagering game. For example, a selectable element 66 associated with a guaranteed-return feature may cause the array of selectable elements 66 to be redisplayed at least one time after a game-terminating outcome, e.g., a collect item, is revealed in the secondary feature, even though the wagering game would normally be terminated at that point. In another embodiment, a selectable element 66 may be associated with a "dynamite" feature 80 that automatically makes additional or extra selections of the selectable elements. According to this feature, instead of receiving awards associated with only the initial three selections, the extra selections that are revealed as a result of selecting the dynamite feature 80 are also credited to the player. For example, in one embodiment, any selectable elements 66 located in positions adjacent to the selectable element associated with the dynamite feature 80 would be revealed and added to the player's award credits. In yet other embodiments, any of the unselected selectable elements 66 may be revealed in a random manner as a result of the dynamite feature 80.

Each of these embodiments and obvious variations thereof is contemplated as falling within the spirit and scope of the claimed invention, which is set forth in the following claims.

What is claimed is:

1. A gaming system comprising:

a wager input device for receiving a wager from a player to play a wagering game;

a display for displaying the wagering game, the wagering game including a primary play field having an array of selectable elements, each of the selectable elements being associated with an award;

a player input device for receiving player selections;

a collect/return input device that, in response to a predetermined number of selections being made from the array of selectable elements, allows the player to blindly select from a secondary play field having at least one continue element and at least one collect-awards element that are separate and different from the array of selectable elements, the at least one collect-awards element allowing the player to collect the awards associated with the selected elements and end the wagering game and the at least one continue element allowing the player to re-enter the primary play field and continue making additional selections from the remaining unselected elements within the array of selectable elements; and wherein upon re-entering the primary play field, a multiplier for modifying the awards associated with the additional selections is awarded each time the player returns to the primary play field.

2. The gaming system of claim 1, wherein the collect/return input device is displayed to the player after the predetermined number of selections have been made by the player.

3. The gaming system of claim 1, wherein the multiplier changes in a random manner each time the player returns to the primary play field.

4. The gaming system of claim 1, wherein the multiplier increases each time the player returns to the primary play field.

5. The gaming system of claim 1, wherein the collect/return input device includes at least one game-terminating outcome for ending the wagering game.

6. The gaming system of claim 1, wherein the collect/return input device allows the player to re-enter the primary play field up to a predetermined number of times.

7. The gaming machine of claim 1, wherein the collect/return input device allows the player to re-enter the primary play field until the player has selected all of the selectable elements in the primary play field.

8. The gaming machine of claim 1, wherein the collect/return input device allows the player to re-enter the primary play field until the player selects a game-terminating outcome associated with the collect/return input device.

9. The gaming machine of claim 1, wherein the collect/return input device allows the player to re-enter the primary play field until a specific multiplier value is achieved.

10. The gaming system of claim 1, wherein at least one award is selected from the group consisting of zero, a monetary value, a multi-pick feature that allows additional selections to be made, and a guaranteed pick feature.

11. A method of conducting a wagering game on a gaming system, the method comprising:

receiving a wager input, via a wager in put device, for playing the wagering game, the wagering game having a primary play field;

displaying, on a display, the primary play field having an array of selectable elements, each of the selectable elements being associated with an award;

receiving a first number of selections from the array of selectable elements;

using a processor to provide a player with a collect/return feature to collect the award associated with the first number of selections or to re-enter the primary play field, the collect/return feature being associated with at least one collect item and at least one re-enter item, the collect item and the re-enter item being indistinguishable to the player and separate from the array of selectable elements;

in response to the player selecting a collect item, distinguishing the collect item from the re-enter item and providing the award associated with the first number of selections to the player; and in response to the player selecting a re-enter item, (i) distinguishing the re-enter item from the collect item; (ii) redisplaying the primary play field with the array of remaining unselected selectable elements, (iii) receiving a second number of selections from the array of remaining unselected selectable elements and (iv) multiplying the awards associated with the second number of selections by a multiplier value.

12. The method of claim 11, further comprising awarding a payout based on the awards associated with the first number of selections and the awards associated with the second number of selections, wherein the awards associated with the second number of selections are modified by the multiplier value.

13. The method of claim 11, further comprising terminating the wagering game in response to the player selecting all of the array of selectable elements in the primary play field.

14. The method of claim 11, further comprising re-displaying the collect/return feature and receiving player input associated with a game-terminating outcome.

15. The method of claim 11, further comprising changing the multiplier value each time the collect/return feature is re-displayed.

16. The method of claim 15, wherein the changing includes increasing the multiplier value or changing the multiplier value in a random manner.

17. The method of claim 11, further comprising re-displaying the collect/return feature a predetermined number of times.

18. The method of claim 11, further comprising re-displaying the collect/return feature until a predetermined multiplier value is achieved by the player.

19. A non-transitory computer readable storage medium encoded with instructions for directing a gaming system to perform the method of claim 11.

20. A gaming system comprising:

a wager input device for receiving a wager from a player to play a wagering game;

a display for displaying an array of selectable elements, each of the selectable elements being associated with an award;

a player input device for receiving selections from the array of selectable elements;

a feature for returning to the array of selectable elements, the feature including additional elements associated with at least one game-return outcome and at least one game-terminating outcome awarding a first award for the selections, the additional elements being separate and distinguishable from the array of selectable elements; and a multiplier that changes each time a game-return outcome is achieved.

21. A method of conducting a wagering game on a gaming system, the method comprising:

receiving a wager input, via a wager input device, from a player to play the wagering game;

displaying, on a display, an array of selectable elements, each of the selectable elements being associated with an award;

receiving player selections from the array of selectable elements;

upon receiving a predetermined number of player selections and exiting the array of selectable elements, using a processor for displaying a feature for re-entering the array of selectable elements to make additional selections;

receiving player input associated with the feature, the feature including at least one game-return outcome and at least one game-terminating outcome, the outcomes being achieved only upon exiting the array of selectable elements;

re-entering the array of selectable elements and receiving an additional number of selections from the array of selectable elements; and multiplying the awards associated with the additional number of selections by a multiplier value that increases with each game-return outcome that is achieved.

* * * * *